United States Patent [19]

Mahan

[11] Patent Number: 4,837,940

[45] Date of Patent: Jun. 13, 1989

[54] GRADER BLADE HEIGHT CONTROL

[76] Inventor: Michael K. Mahan, 720 Fielding Rd., Sidney, Ohio 45365

[21] Appl. No.: 182,965

[22] Filed: Apr. 18, 1988

[51] Int. Cl.[4] ..... E02F 5/00

[52] U.S. Cl. ..... 33/624; 172/783; 172/797; 172/239; 37/108 R; 37/DIG. 19

[58] Field of Search ..... 172/239, 783, 797; 37/DIG. 19, 105, 104, 108, 108 R, 108 A; 33/624

[56] References Cited

U.S. PATENT DOCUMENTS

| | | | |
|---|---|---|---|
| 2,503,408 | 4/1950 | Phillips | 33/185 |
| 2,510,523 | 6/1950 | Schiavi | 172/783 X |
| 2,844,882 | 7/1958 | Earley et al. | 33/185 |
| 3,011,275 | 12/1961 | White, Jr. | 172/430 |
| 3,127,689 | 4/1964 | Hopkins | 172/783 X |
| 3,266,050 | 8/1966 | Reeder | 172/797 X |
| 3,678,885 | 7/1972 | Ferguson | 172/430 |
| 3,786,871 | 1/1974 | Long et al. | 37/108 R |
| 3,813,181 | 5/1974 | Barnes, III | 404/84 |
| 3,900,073 | 8/1975 | Crum | 172/430 |
| 4,125,950 | 11/1978 | Mashford | 172/783 X |
| 4,215,495 | 8/1980 | Wagner | 172/239 X |
| 4,607,705 | 8/1986 | Tebben | 172/430 |

*Primary Examiner*—William D. Martin, Jr.

*Attorney, Agent, or Firm*—Gifford, Groh, Sheridan, Sprinkle and Dolgorukov

[57] ABSTRACT

A height control device for attachment to the end of a grader blade of a motor grader. A gage portion of the device is adjustable for the desired depth of a cut the blade will make with reference to a curb upon which the gage rides.

2 Claims, 1 Drawing Sheet

GRADER BLADE HEIGHT CONTROL

FIELD OF THE INVENTION

This invention relates to an attachment for a grader blade, and, more particularly to an adjustable grade height establishing device for controlling the height of the grader blade relative to an established curb.

DESCRIPTION OF THE PRIOR ART

There are a wide variety of devices on the market to establish a visual indication of the height of a grader blade or other working tool with respect to a known datum or level.

For example, U.S. Pat. No. 3,813,181 to Barnes, III, utilizes a series of transversely located rollers on a beam behind the grader blade which contact the ground. A sensor arm attached to the roller actuates independent high, low and center switches. U.S. Pat. No. 3,900,073 to Crum utilizes a combination of bubble levels and gages to indicate the position of a grader blade relative to the frame of the machine. U.S. Pat. No. 2,503,408 to Phillips shows the use of stakes on both sides of the machine having a line or mark at a predetermined distance above level which the operator attempts to hit with a spring loaded feeler rod as the grader blade moves past the individual stakes. U.S. Pat. No. 2,844,882 to Earley, et al and U.S. Pat. No. 3,011,275 to White, Jr. both teach the use of wires as a reference. Earley uses wires on both sides of a concrete slab laying machine, White, Jr. utilizes a railroad track levelling technique with front and rear buggies which suspend a taut wire upon which a level indicator rides. U.S. Pat. No. 3,678,885 to Ferguson mounts a slope and grade meter on a grader blade, and in one embodiment, the desired level is compared to the actual level measured by a feeler riding on a curb.

At best, prior art devices have provided visual indication to the motor grader operator of the position of his grader blade relative to a desired position so that he could manually adjust the height of the grader blade.

SUMMARY OF THE INVENTION

The present invention provides an adjustable grade height establishing device which attached to the end of a grader blade of a motor grader to control the height of the blade. A mounting plate attached to the face of the grader blade adjacent one end of the grader blade and has a gage mounting area on the plate adapted to extend beyond the edge of the grader blade. A gage has a planar mounting surface which abuts against the gage mounting area of the mounting plate and is adjustably attached thereto. The gage has a planar curb contacting surface. Preferably the gage is L-shaped with the planar mounting surface constituting the longer leg of the L and the curb engaging surface constituting the shorter leg of the L. The position of the gage relative to the mounting plate is adjusted to establish a given position of the grader blade relative to the curb. Thereafter, a motor grader is operated with the grader blade floating so that its height is established by the gage riding on the curb. There is thus no need for a position indicator which the operator would use to compare to a desired position for manual manipulation of the blade height.

In the preferred form, the mounting plate is bolted to a face of the grader blade adjacent to one end of the blade and the gage mounting area of the mounting plate is provided with two substantially horizontally aligned mounting holes. The mounting surface of the gage has two spaced substantially vertical slots so that it can be attached to the mounting plate by bolts which pass though the mounting plate holes and gage slots. The slots provide means for adjustably attaching the gage to the mounting plate.

To facilitate adjustment of the gage relative to the mounting plate, adjustment brackets are provided on the gage mounting area of the mounting plate and the mounting surface of the gage. A bolt or threaded rod extends through these brackets to provide rapid adjustment of the gage relative to the mounting plate when the securing nuts and bolts are loosened.

The foregoing invention and its advantages will become more apparent from the following description and the accompanying drawings:

BRIEF DESCRIPTION OF THE DRAWING

Referring to FIGS. 1 and 2, motor grader 10 has a conventional grader blade 12 with the grade height establishing device 14 of this invention attached thereto in a manner that it will ride along the curb line shown schematically by line 16 so that the grader blade 12 will be cutting a path at the ground level shown at 18.

FIG. 2 shows the height establishing device 14 as it is attached to the rearward side of grader blade 12 by bolts 22 which pass through the blade 12 and the mounting plate 24 of the height establishing device 14. A gage portion 26 of the height control device 14 is shown attached to mounting plate 24 by bolts 28 in a position that it will ride on curb 30 to establish the overall height of the blade 12. The front tire 20 is shown merely to give the viewer a reference to the motor grader 10 and does not necessarily represent the level at which this tire will be riding on the ground.

Figure 1:
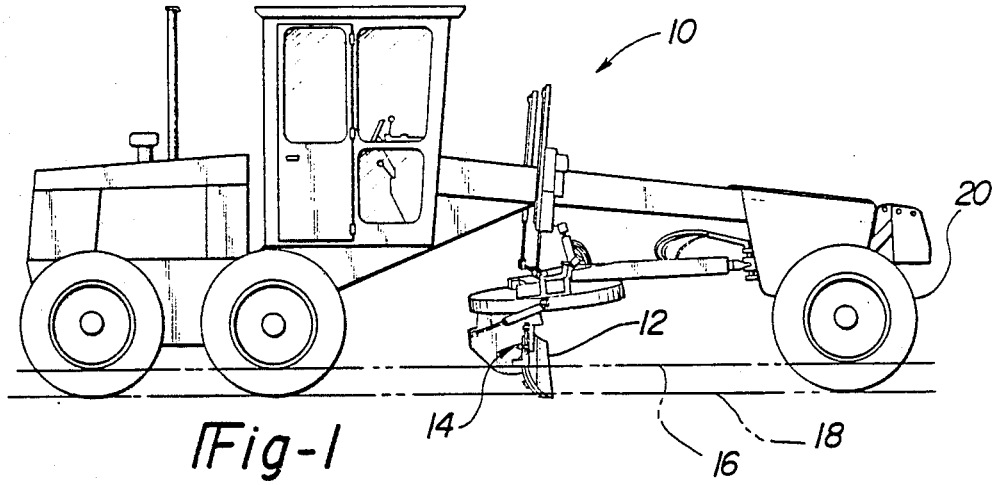
FIG. 1 is a plan view of a motor grader having a conventional grading blade to which is attached the grade height establishing device of this invention.
Figure 2:
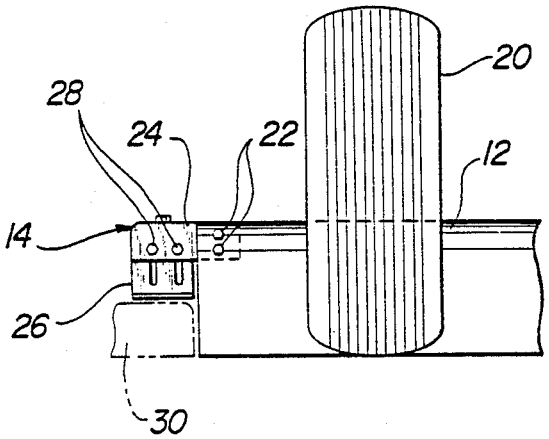
FIG. 2 is a front elevation view showing the device of this invention attached to the end of a grader blade and its relationship to the motor grader tire and curb which establishes the positioning of the grader blade.
Figure 3:
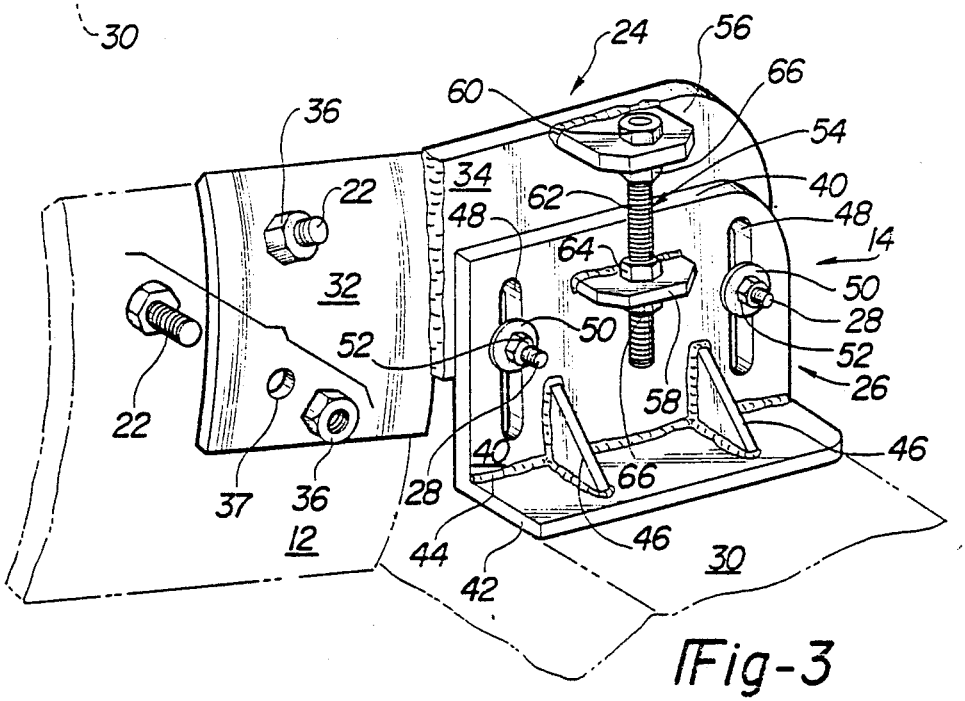
FIG. 3 is a perspective view showing the details of this invention and its attachment to a grader blade and its working relationship to a curb.

As shown in more detail in FIG. 3, the mounting plate 24 of height control device 14 can be fabricated from two separate plates 32 and 34 which are welded together at 38. Also the plate 34 may be at a slight angle to plate 32 to allow the grader blade to pull stone away from the curb faster and to keep the stone off the curb lip. This angle would be no greater than 15° and in some instances would be omitted entirely. Also, mounting plate 24 can be a single piece. Mounting plate portion 32 overlaps and abuts against the face of grader blade 12 and is mounted thereto by bolts and nuts 22 passing through a pair of vertically aligned holes 37 in mounting plate 24 and the grader blade 12, being secured by nuts 36.

Plate 34 serves as the gage mounting area of mounting plate 24 having a pair of generally horizontal aligned mounting holes through which the bolts 28 pass. Gage 26 is L-shaped having a planar mounting portion 40 constituting the longer leg of the L which abuts against the gage mounting area 34 of mounting plate 24. The shorter leg of the L constitutes the curb contacting portion 42 of the gage 14. Gage 14 is conveniently formed with the two separate plates 40 and 42 welded together as shown at 44 and reinforced with gusset plates 46 as shown. Substantially vertically extending spaced slots 48 in mounting portion 40 of gage 14 receive the mounting bolts 28 for attachment of the gage 14 to mounting plate 24 with washers 50 and nuts 52.

In order to facilitate the adjustment of the gage relative to the mounting plate to suit varying curb heights and depths of finish grading, threaded adjustment unit 54 is located between slots 48. Threaded adjustment unit 54 includes a mounting plate 56 welded to the top portion of plate 34 and an aligned mounting bracket 58 which is welded to a mounting portion 40 of gage 26 midway between the slots 48. A nut 60 is welded to the end of threaded stud 62, and another nut 64 is welded to bracket 58. When the nuts 52 on attaching bolts 28 are loosened, and the stud 62 is passed through a hole in mounting bracket 56 and threaded into nut 64, it will act as a vertical adjustment device by turning the nut 60. Stop nut 66 may also be threaded onto the stud 62 to lock stud 62 in its adjusted position by tightening against the mounting brackets 56 and 58. It is apparent that a bolt can be used in place of stud 62 and nuts 60 and the claims generally cover either construction. Further modifications can be made such as threading of bracket 58 to eliminate nut 64 welded to bracket 58.

Height control device 14 thus provides means to establish a finished grade in a roadway having a curb 30 with a motor grader 10 having a standard grader blade 12. The mounting plate 24 is bolted to the grader blade 12. The position of the gage 26 on the mounting plate 24 is adjusted to establish the desired grade. This is accomplished by loosening the nuts 52 on mounting bolts 28 and also loosening stop nuts 66 on threaded stud 62. The nut 60 is then turned in a clockwise or counterclockwise direction to raise or lower the gage 26 relative to the mounting plate 24. When the desired position is reached, the stop nuts 66 are tightened against brackets 56 and 58 and the nuts 52 are tightened on bolts 28. Gage surface 42 is then placed on the curb 30 and the motor grader is operated with the grader blade floating so that its height is established by the gage 26 riding on curb 30.

The embodiments of the invention in which an exclusive property or privilege is claimed are defined as follows:

1. An adjustable grade height establishing device for attachment to the end of a grader blade of a motor grader comprising:

a mounting plate having spaced mounting holes at one end for attachment to the face of a grader blade adjacent one end of the grader blade with bolts passing through said mounting holes and grader blade and a gage mounting area adapted to extend beyond the edge of the grader blade;

an L-shaped gage with a planar mounting surface constituting the longer leg of the L for abutment with the gage mounting area of said mounting plate and a curb contacting surface constituting the shorter leg of the L; and means for adjustably attaching the planar mounting surface of said gage to the mounting area of said mounting plate, said means including a pair of spaced apertures in one of said gage mounting area of said mounting plate and the mounting surface of said gage and a pair of spaced substantially vertical slots in the other of said gage mounting area of said mounting plate and the mounting surface of said gage, and a pair of bolts passing through said apertures and slots and nuts on said bolts for securing said gage in a fixed position relative to said mounting plate;

whereby said L-shaped gage will ride on said curb with the shorter planar curb contacting surface of the L establishing the working height of the grader blade, and the longer planar surface of the L clearing any material deposited on the curb.

2. The adjustable grade height establishing device of claim 1 further including a bolt in engagement with adjustment brackets extending from the gage mounting area of said mounting plate and the mounting surface of said gage for rapidly adjusting the position of said gage with respect to said mounting plate when said nuts are loosened.

* * * * *